US012245681B2

(12) United States Patent
Demin et al.

(10) Patent No.: US 12,245,681 B2
(45) Date of Patent: Mar. 11, 2025

(54) FREE-STANDING HAMMOCK STAND

(71) Applicant: Yellow Leaf Hammocks, LLC, Venice, CA (US)

(72) Inventors: Iosef Demin, Venice, CA (US); Rachel Connors, Venice, CA (US); Bryce Gibson, Dedham, MA (US); Kurt MacLaurin, Lincoln, MA (US)

(73) Assignee: Yellow Leaf Hammocks, LLC, Venice, CA (US)

( * ) Notice: Subject to any disclaimer, the term of this patent is extended or adjusted under 35 U.S.C. 154(b) by 1068 days.

(21) Appl. No.: 17/171,922

(22) Filed: Feb. 9, 2021

(65) Prior Publication Data

US 2021/0321752 A1 Oct. 21, 2021

Related U.S. Application Data

(63) Continuation-in-part of application No. 16/849,541, filed on Apr. 15, 2020, now Pat. No. 10,912,375.

(51) Int. Cl.
*A47C 3/18* (2006.01)
*A45F 3/24* (2006.01)

(52) U.S. Cl.
CPC ..... *A45F 3/24* (2013.01)

(58) Field of Classification Search
CPC ..... A45F 2/22; A45F 2/24; A45F 2/26; A47C 3/18; A47C 3/185; A47C 3/0255
See application file for complete search history.

(56) References Cited

U.S. PATENT DOCUMENTS 402,307 A * 4/1889 Collins ..... A45F 3/24 135/96
2,217,943 A * 10/1940 Carlson ..... A47C 9/007 248/417
3,713,618 A * 1/1973 Hendrickson ..... F16C 11/04 248/417

(Continued)

FOREIGN PATENT DOCUMENTS

KR 2020190001331 U 6/2019

OTHER PUBLICATIONS

Michelle Simakis, 5 Patio furniture trends for 2018, Mar. 22, 2018, gardencenter media, https://www.gardencentermag.com/article/5-patio-furniture-trends-for-2018/.*

(Continued)

*Primary Examiner* — Justin C Mikowski
*Assistant Examiner* — Ifeolu A Adeboyejo
(74) *Attorney, Agent, or Firm* — Kolitch Romano Dascenzo Gates LLC

(57) ABSTRACT

A hammock stand includes two structural support arms extending from a central base and configured to support a hammock above the base. Each support arm has a curved shape bowing inward at upper ends, such that an overall shape of the hammock stand is tapered. The hammock stand is configured to support a hammock occupant generally oriented transverse to an axis defined along the structural support arms. The structural support arms are coupled to the central base by a coupling assembly. In some examples, the coupling assembly includes a yoke configured to couple the structural support arms to a rotary bearing. The rotary bearing allows the structural support arms, and therefore the hammock, to swivel relative to the base.

8 Claims, 13 Drawing Sheets

(56) References Cited

U.S. PATENT DOCUMENTS

| | | | | | |
|---|---|---|---|---|---|
| 4,097,016 | A * | 6/1978 | Petrucci | A47C 3/18 | 108/142 |
| 5,039,164 | A * | 8/1991 | Gibbs | A47C 3/0252 | 297/285 |
| 5,224,225 | A * | 7/1993 | Singleton, Jr. | A45F 3/24 | 5/127 |
| 5,782,451 | A * | 7/1998 | Carnahan | A47C 3/18 | 248/349.1 |
| 6,748,616 | B1 * | 6/2004 | Tseng | A45F 3/24 | 5/120 |
| 6,973,687 | B1 * | 12/2005 | Tseng | A45F 3/24 | 5/127 |
| 9,776,576 | B1 * | 10/2017 | McDermott | B60P 3/34 | |
| D964,080 | S * | 9/2022 | Tsanev | D6/718.11 | |
| 2007/0200406 | A1 | 8/2007 | Hathaway | | |
| 2014/0292053 | A1 * | 10/2014 | Chou | A47C 3/185 | 297/344.21 |
| 2019/0000220 | A1 | 1/2019 | Lemmens | | |
| 2019/0365085 | A1 | 12/2019 | Goodwin et al. | | |
| 2021/0100341 | A1 * | 4/2021 | Tsanev | A45F 3/24 | |

OTHER PUBLICATIONS

Korean Intellectual Property Office, International Search Report and Written Opinion of the International Searching Authority, dated Jan. 15, 2021, in PCT/US2020/028301.

* cited by examiner

FREE-STANDING HAMMOCK STAND

CROSS-REFERENCES

The following applications and materials are incorporated herein, in their entireties, for all purposes: U.S. patent application Ser. No. 16/849,541, filed Apr. 15, 2020, now U.S. Pat. No. 10,912,375.

FIELD

This disclosure relates to systems and methods for supporting hammocks, and more specifically to free-standing hammock stands.

INTRODUCTION

Known methods of supporting a hammock suffer from various drawbacks. For example, it can be problematic to attach a hammock to walls of a building or other internal structures, due to the heavy loads imparted by a hammock when in use. Known free-standing hammock stands with two points of support for the hammock generally have large footprints. This can make them impractical for use indoors or in certain outdoor spaces (e.g., porches, small yards, camp sites, etc.), because they occupy a large amount of space while providing relatively little seating. Other free-standing hammock stands provide a single overhead point of support for both ends of the hammock, resulting in a relatively unstable, confining configuration of the hammock. Additionally, many known hammock stands have a utilitarian appearance and detract from the aesthetic appeal of the indoor or outdoor space in which they are located. Better solutions are needed.

SUMMARY

The present disclosure provides systems, apparatuses, and methods relating to hammock stands.

In some embodiments, a free-standing hammock stand comprises: a base including a rotary bearing; and a support structure including: a lower portion coupled to the rotary bearing, and two curved support arms extending generally upwardly and away from the lower portion, wherein a distal portion of each support arm is configured to support an end of a hammock; wherein the rotary bearing is configured to allow rotation of the support structure relative to the base, and wherein the support structure includes a recess formed in the lower portion, and the recess is configured to accommodate the rotary bearing.

In some embodiments, a hammock stand comprises: a support structure including a pair of curved support arms configured to attach to a base, each curved support arm having a distal end configured to support a side of a hammock; wherein each curved support arm includes a notch formed at a lower proximal end of the curved support arm, and the notches are shaped to accommodate at least a portion of the base when the curved support arms are joined to the base.

In some embodiments, a hammock stand comprises: a support structure including a pair of curved support arms each having a proximal end attached to a base and a distal end configured to support a side of a hammock; wherein the distal ends of the curved support arms curve toward each other, such that a distance between the distal ends is smaller than a width of a widest portion of the support structure.

Features, functions, and advantages may be achieved independently in various embodiments of the present disclosure, or may be combined in yet other embodiments, further details of which can be seen with reference to the following description and drawings.

DETAILED DESCRIPTION

Figure 1:
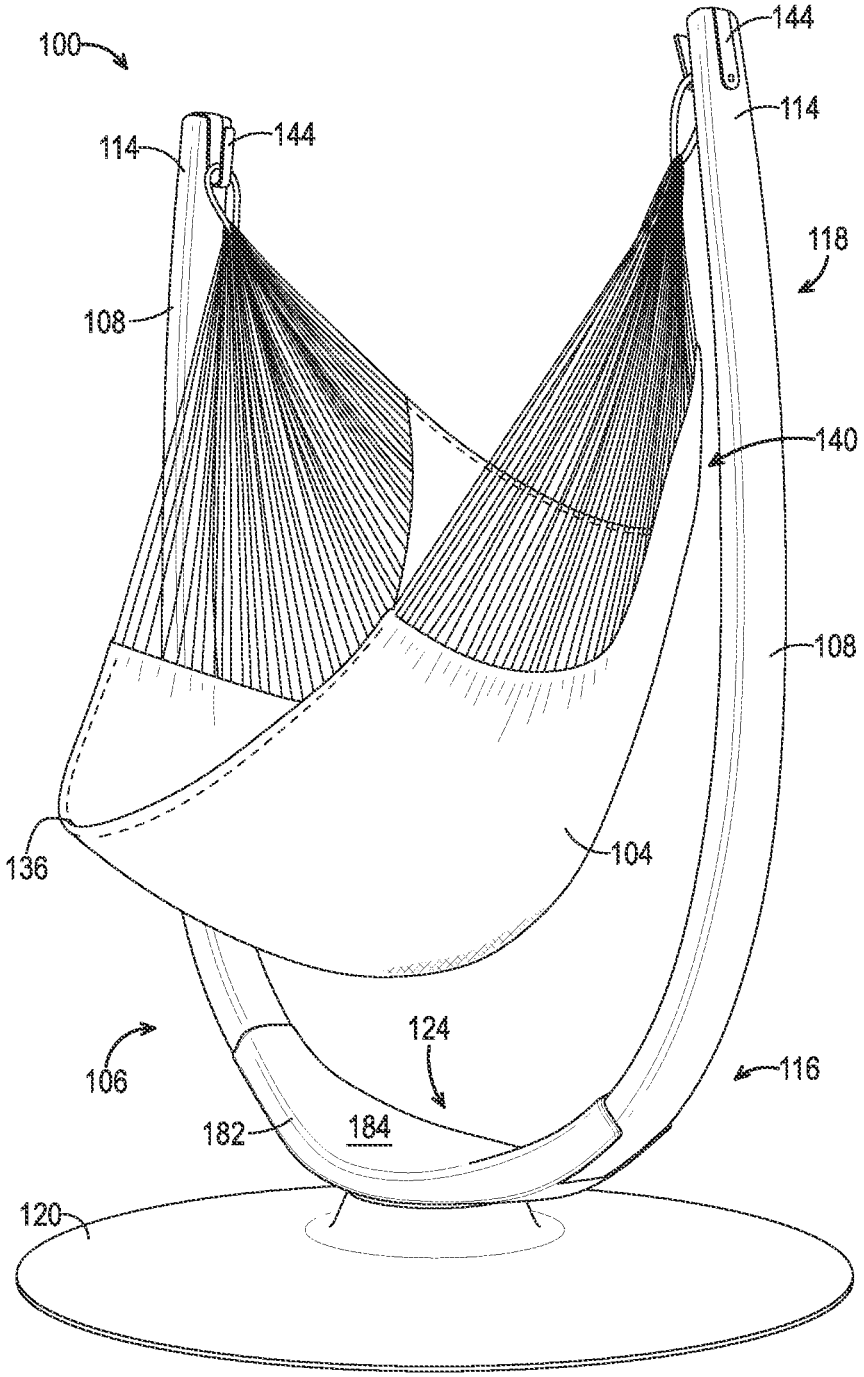
FIG. 1 is an isometric view of an illustrative hammock stand supporting a hammock, in accordance with aspects of the present teachings.

Various aspects and examples of a free-standing hammock stand, as well as related methods, are described below and illustrated in the associated drawings. Unless otherwise specified, a hammock stand in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Elongate" or "elongated" refers to an object or aperture that has a length greater than its own width, although the width need not be uniform. For example, an elongate slot may be elliptical or stadium-shaped, and an elongate candlestick may have a height greater than its tapering diameter. As a negative example, a circular aperture would not be considered an elongate aperture.

The terms "inboard," "outboard," "forward," "rearward," and the like are intended to be understood in the context of a host vehicle on which systems described herein may be mounted or otherwise attached. For example, "outboard" may indicate a relative position that is laterally farther from the centerline of the vehicle, or a direction that is away from the vehicle centerline. Conversely, "inboard" may indicate a direction toward the centerline, or a relative position that is closer to the centerline. Similarly, "forward" means toward the front portion of the vehicle, and "rearward" means toward the rear of the vehicle. In the absence of a host vehicle, the same directional terms may be used as if the vehicle were present. For example, even when viewed in isolation, a device may have a "forward" edge, based on the fact that the device would be installed with the edge in question facing in the direction of the front portion of the host vehicle.

"Coupled" means connected, either permanently or releasably, whether directly or indirectly through intervening components.

"Resilient" describes a material or structure configured to respond to normal operating loads (e.g., when compressed) by deforming elastically and returning to an original shape or position when unloaded.

"Rigid" describes a material or structure configured to be stiff, non-deformable, or substantially lacking in flexibility under normal operating conditions.

"Elastic" describes a material or structure configured to spontaneously resume its former shape after being stretched or expanded.

Directional terms such as "up," "down," "vertical," "horizontal," and the like should be understood in the context of the particular object in question. For example, an object may be oriented around defined X, Y, and Z axes. In those examples, the X-Y plane will define horizontal, with up being defined as the positive Z direction and down being defined as the negative Z direction.

"Providing," in the context of a method, may include receiving, obtaining, purchasing, manufacturing, generating, processing, preprocessing, and/or the like, such that the object or material provided is in a state and configuration for other steps to be carried out.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

OVERVIEW

In general, a hammock stand in accordance with aspects of the present teachings includes a pair of elongate support arms coupled to a central base and configured to support a hammock above the base. In the examples depicted below, the support arms each have an arcuate shape, but in general any shape suitable for supporting a hammock may be used.

In some examples, the support arms are coupled to the base via a coupling assembly including a rotary bearing configured to allow the support arms and hammock to swivel (e.g., up to 360 degrees and beyond). For example, in some cases the coupling assembly is configured to allow the support arms and hammock to rotate freely up to and past 360 degrees (e.g., with no limitation on the rotation). In some examples, the coupling assembly is configured to allow the support arms and hammock to rotate less than 360 degrees (e.g., to swivel only within an angular span of less than 360 degrees, less than 180 degrees, or less than any other suitable maximum number of degrees). In some examples, the coupling assembly is configured to allow the support arms and hammock to rotate up to 360 degrees, but no further (e.g., the support arms and hammock are not able to rotate past approximately 360 degrees). Optionally, the rotary bearing may be selectively lockable to limit and/or prevent swiveling. In some examples, the rotary bearing is omitted, and the support arms are coupled to the base in a manner that does not allow the support arms and hammock to swivel.

The support arms of the hammock stand extend symmetrically from the base, defining a longitudinal axis. The support arms, together with the coupling assembly and base, are configured to support a hammock having an occupant generally positioned transverse to the longitudinal axis. This may allow the hammock stand to have a more compact footprint than conventional hammock stands, in which the occupant is generally positioned along the longitudinal axis. However, an occupant of the hammock stand described herein can assume any suitable or desired position.

EXAMPLES, COMPONENTS, AND ALTERNATIVES

The following sections describe selected aspects of illustrative hammock stands as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Hammock Stand

With reference to FIGS. 1-15, this section describes an illustrative hammock stand 100, which is an example of the hammock stand described generally above.

Figure 2:
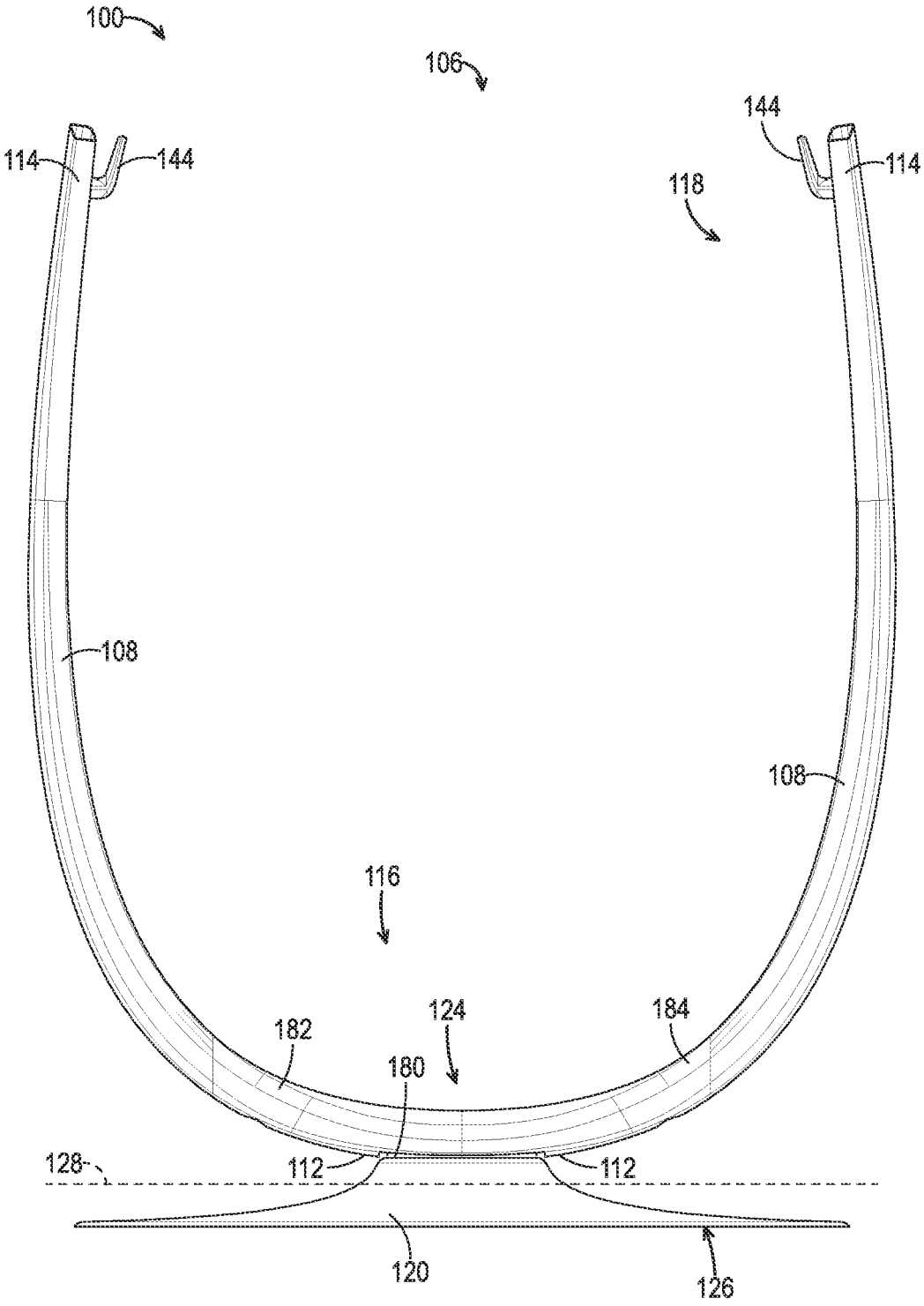
FIG. 2 is a front view of the hammock stand of FIG. 1.
Figure 3:
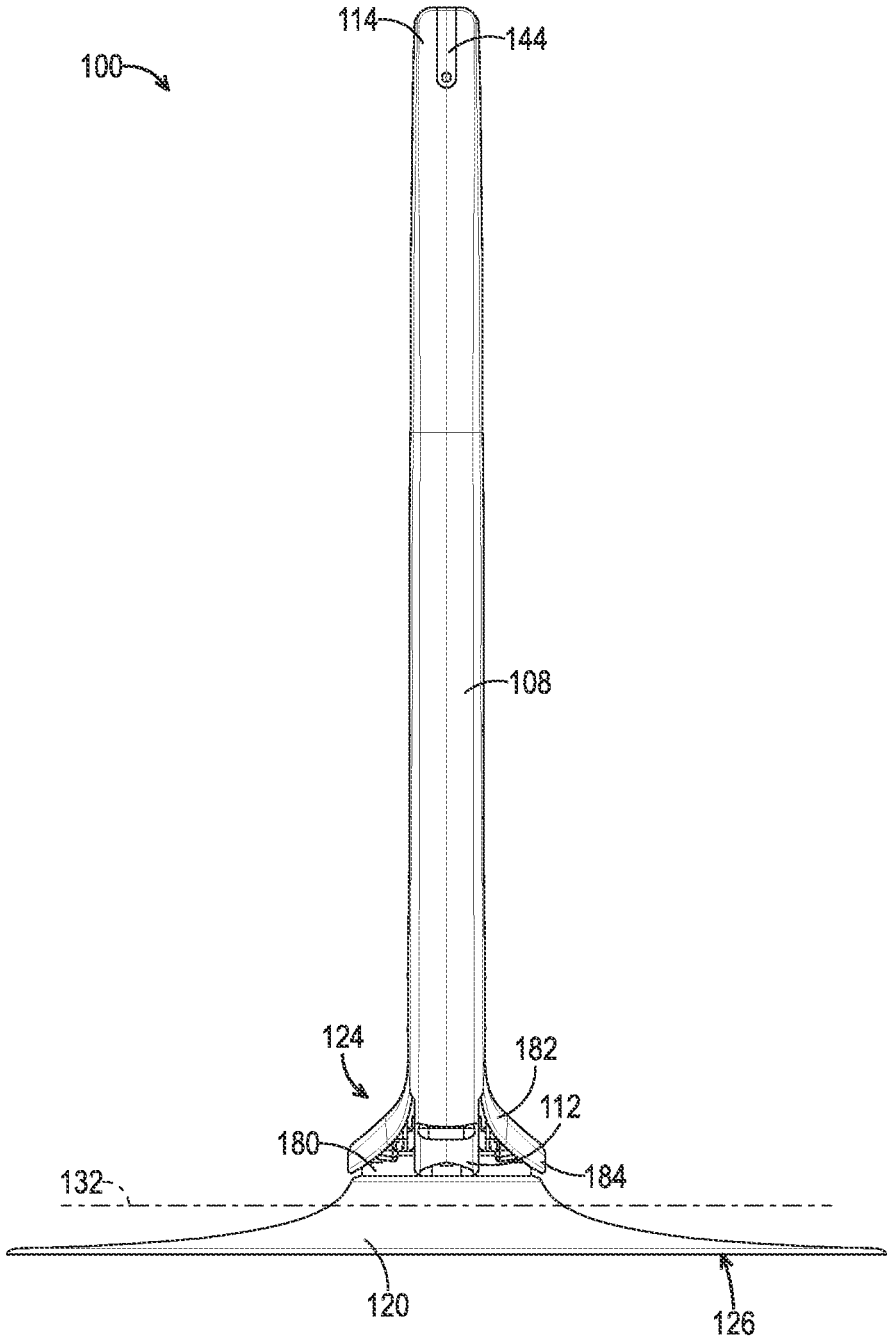
FIG. 3 is a side view of the hammock stand of FIG. 1.

FIGS. 1-3 depict hammock stand 100. Specifically, FIG. 1 is an isometric view of hammock stand 100, FIG. 2 is a front view of the hammock stand, and FIG. 3 is a side view of the hammock stand. FIG. 1 depicts hammock stand 100 supporting an illustrative hammock 104; in the other drawings, the hammock is omitted for clarity.

As shown in FIGS. 1-3, hammock stand 100 includes a U-shaped support structure generally indicated at 106, comprising two curved support arms 108 configured to support hammock 104. In the depicted example, each support arm 108 extends in an arcuate shape between a proximal or first end 112 and a distal or second end 114. A radius of curvature of U-shaped support structure 106 is generally smaller at a lower portion 116 of the U-shaped support structure and greater at a higher portion 118; said another way, support arms 108 are more curved near the bottom of stand 100 than near the top. In other examples, the support arms may be differently curved, for instance in circular sections of constant curvature, or in shapes with greater curvature than this example near the bottom of the support stand.

In hammock stand 100, support arms 108 bow toward each other slightly at second ends 114, such that U-shaped support structure 106 has a slightly tapered shape. In other examples, however, the support arms may have any suitable shape, including different degrees of curvature, tapering, asymmetry and/or one or more rectilinear portions. Support arms 108 may comprise metal, plastic, wood, and/or any other suitable material(s).

In some examples, the support arms are integrally formed as a single U-shaped component (i.e., a one-piece U-shaped support structure). However, using two discrete support arms, as in the depicted example of hammock stand 100, generally allows the hammock stand to be disassembled and stored in smaller pieces than would be possible with a single integral component.

First ends 112 of support arms 108 are coupled to a base 120 by a coupling assembly 124. Base 120 has a generally frustoconical shape with sides having a concave profile. A cross-sectional shape of base 120 is annular. Base 120 has a bottom surface 126 comprising an annular rim configured to rest on an underlying support surface (e.g., the ground, a floor, and/or any other suitable surface).

Support arms 108 extend symmetrically from coupling assembly 124 in opposing directions, defining a longitudinal axis 128 (see FIG. 2). A transverse axis 132 (see FIG. 3) extends orthogonally from longitudinal axis 128. Coupling assembly 124 is disposed at a central portion of base 120. The symmetric shape of base 120 and the symmetric arrangement of arms 108 and coupling assembly 124 allows hammock stand 100 to stably support hammock 104 and any occupant of the hammock, even in examples wherein the hammock and support arms swivel relative to the base. In other examples, however, another suitable base shape or arm arrangement may be used.

Based at least on this configuration, hammock stand 100 is configured to support hammock 104 with an occupant of the hammock generally oriented along transverse axis 132, i.e., with the occupant's body extending transverse to the plane defined by the support arms. Hammock stand 100 and hammock 104 are configured to support loads imposed by a person sitting or lying with their feet adjacent a first hammock side 136 and their head adjacent an opposing second hammock side 140. Supporting an occupant in this position can allow hammock stand 100 to have a smaller footprint than a conventional hammock stand designed to support an occupant lying along the longitudinal axis. For example, a distance between support arms 108 can be shorter than a distance between hammock-end supports in a conventional hammock stand. However, hammock stand 100 and hammock 104 allow a user to occupy the hammock in other positions (i.e., other than lying or sitting along transverse axis 132).

Hammock 104 depicted in FIG. 1 is an illustrative example of a hammock suitable use with hammock stand 100. In general, hammock stand 100 is configured to support other types of hammocks as well, including many conventional types of hammocks that are not specifically designed for use with hammock stand 100.

Figure 4:
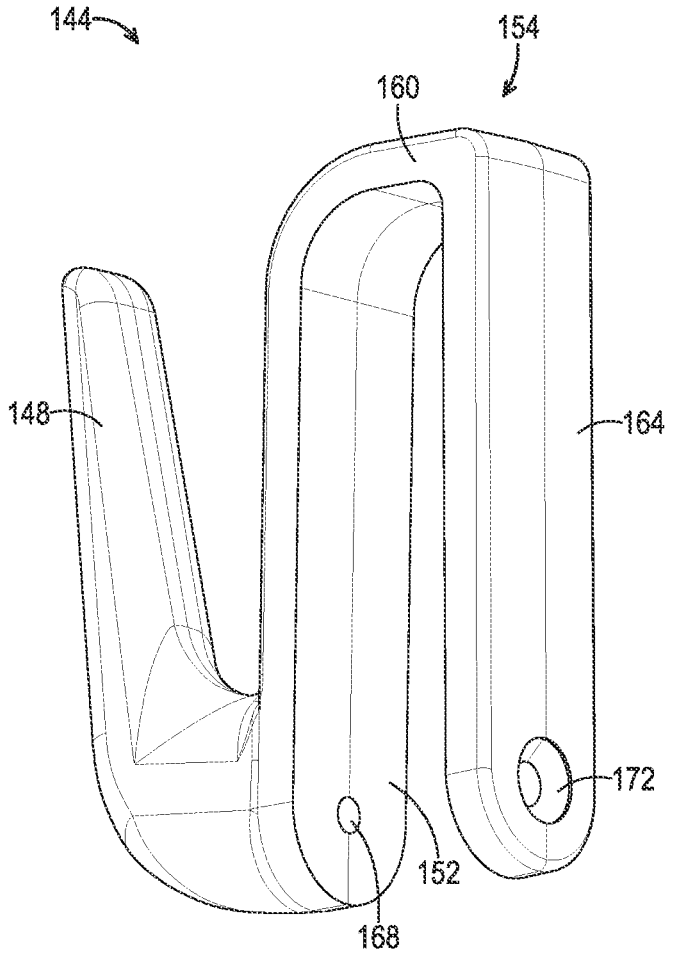
FIG. 4 is an isometric view of an illustrative hook of the hammock stand of FIG. 1.

Ends of hammock 104 are mounted on respective S-shaped hooks 144, which are disposed at distal or second ends 114 of support arms 108. FIG. 4 is an isometric view of one of hooks 144. Roughly speaking, one portion of the S-shape of hook 144 is configured to support the hammock, and the other portion of the S-shape of hook 144 is configured to attach securely to the distal end of the support arm.

More specifically, hook 144 includes a hook-shaped projection 148 configured to receive an attachment portion of a hammock (e.g., a loop). Hook-shaped projection 148 projects from a base plate 152 configured to engage a side of second end 114 of arm 108. A mount 154 extending from base plate 152 is configured to secure hook 144 to arm 108. Mount 154 includes an orthogonal portion 160 extending from an upper end of base plate 152 and a parallel portion 164 extending from the orthogonal portion parallel to the base plate. Hook 144 is configured to receive second end 114 of arm 108 between base plate 152 and parallel portion 164, with orthogonal portion 160 engaging a top surface of the second end of the arm. A first bore 168 within base plate 152 and a second bore 172 within parallel portion 164 are configured to receive a fastener (not shown) passing through second end 114 to fasten hook 144 to support arm 108. Hook 144 may comprise metal, plastic, wood, and/or any other suitable material(s).

Figure 5:
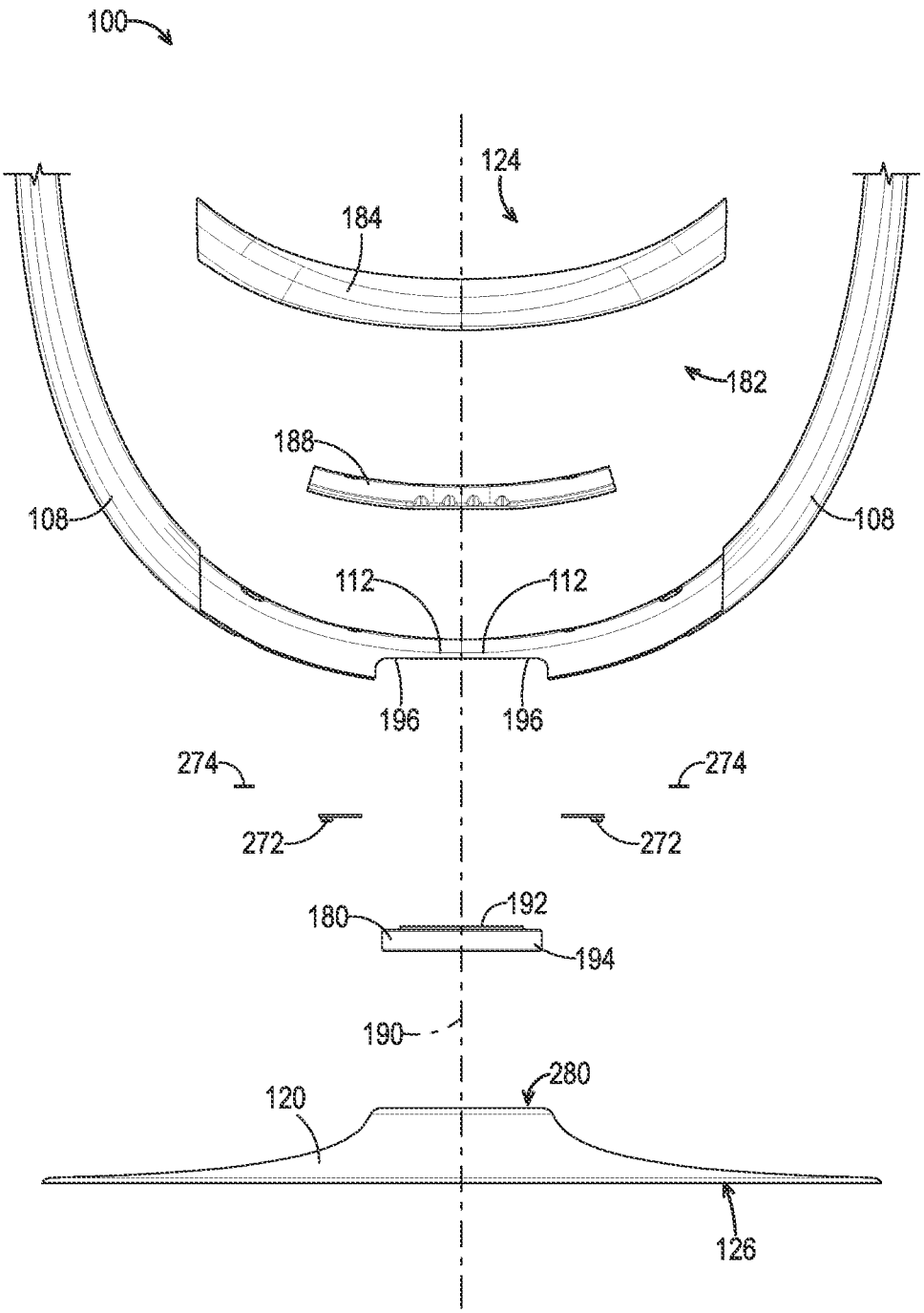
FIG. 5 is a partial exploded view of the hammock stand of FIG. 1.
Figure 6:
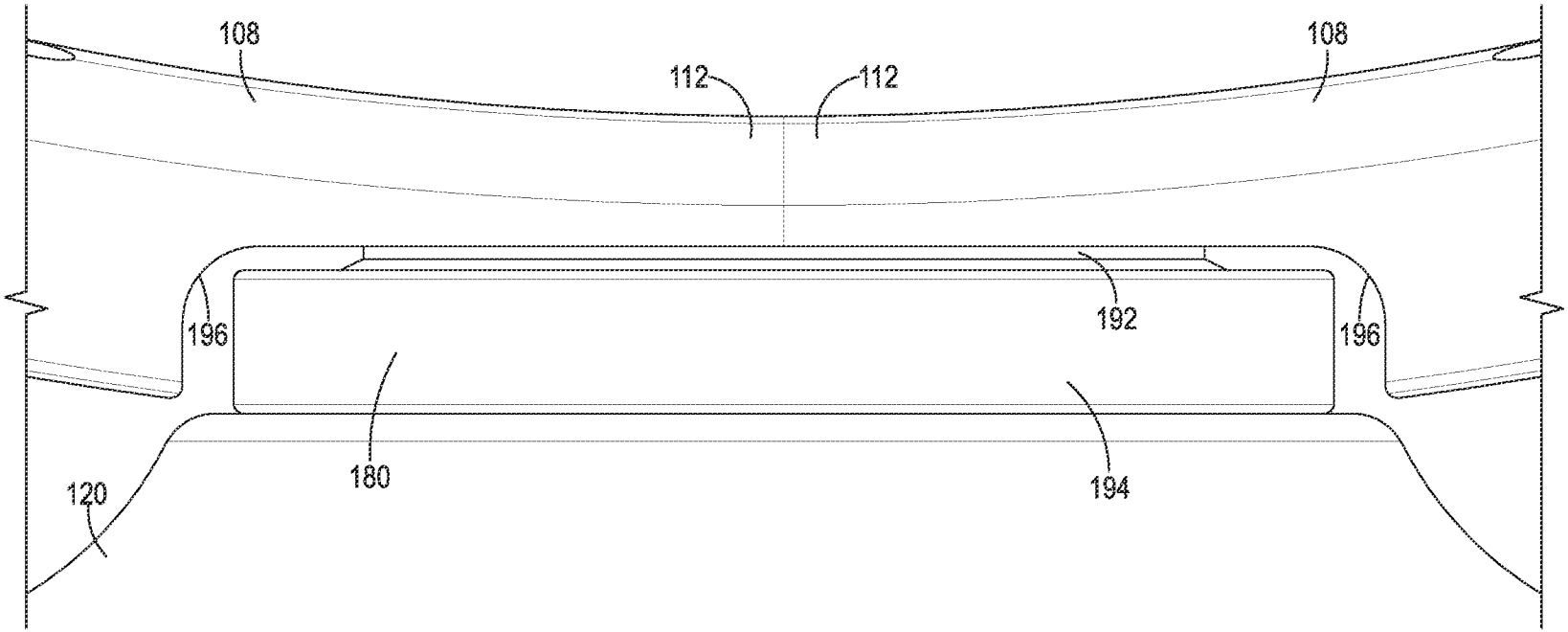
FIG. 6 is a partial front view of the hammock stand of FIG. 1 omitting a yoke of the hammock stand for clarity.

Support arms 108 are coupled to base 120 by coupling assembly 124, as depicted in FIGS. 5-6. As shown in FIG. 5, which is an exploded front view of hammock stand 100, coupling assembly 124 includes a rotary bearing 180 and a yoke generally indicated at 182. Yoke 182 includes a yoke cover 184 and a yoke plate 188 configured to be disposed between the yoke cover and support arms 108.

Rotary bearing 180 is configured to allow support arms 108 to swivel relative to base 120 about a rotation axis 190. Rotary bearing 180 has an inner portion 192 and an outer portion 194 configured to rotate independently of each other. Outer portion 194 is rigidly coupled to base 120. Inner portion 192 of rotary bearing 180 is rigidly attached to yoke 182 and to each support arm 108.

Support arms 108 each have a recess 196 at first end 112 to accommodate rotary bearing 180 (see FIG. 6, a front view in which yoke 182 is omitted for clarity).

Yoke 182 couples support arms 108 to each other and to rotary bearing 180. Yoke plate 188 is disposed between yoke cover 184 and support arms 108. Yoke cover 184 at least partially covers the yoke plate and rotary bearing 180, thereby preventing damage and increasing the aesthetic appeal of the hammock stand.

Figure 7:
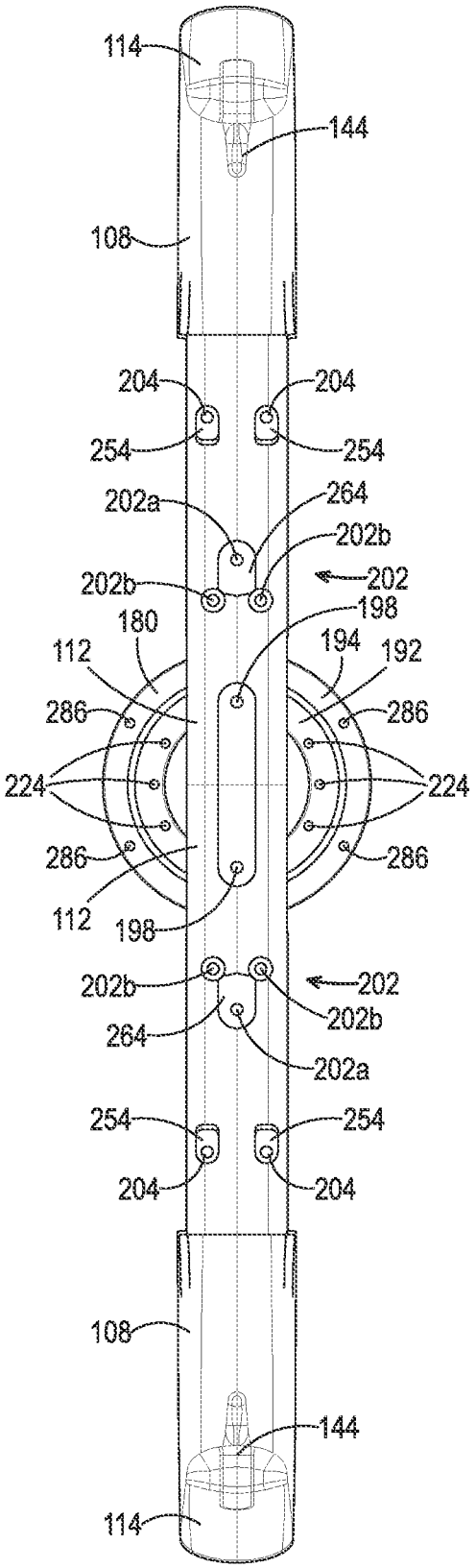
FIG. 7 is a top view of the hammock stand of FIG. 1, omitting a base and the yoke for clarity.

FIG. 7 is a top view of hammock stand 100 with yoke 182 removed to show the proximal or first ends 112 of support arms 108. Base 120 is also omitted for simplicity. As shown in FIG. 7, each support arm 108 has a first aperture 198 disposed adjacent first end 112, a set of second apertures 202 disposed farther from the first end, and a set of third apertures 204 disposed yet farther along the second end. In the depicted example, each support arm 108 includes exactly one first aperture 198, three second apertures 202 and two third apertures 204, but in other examples, other suitable numbers of apertures may be used.

Figure 8:
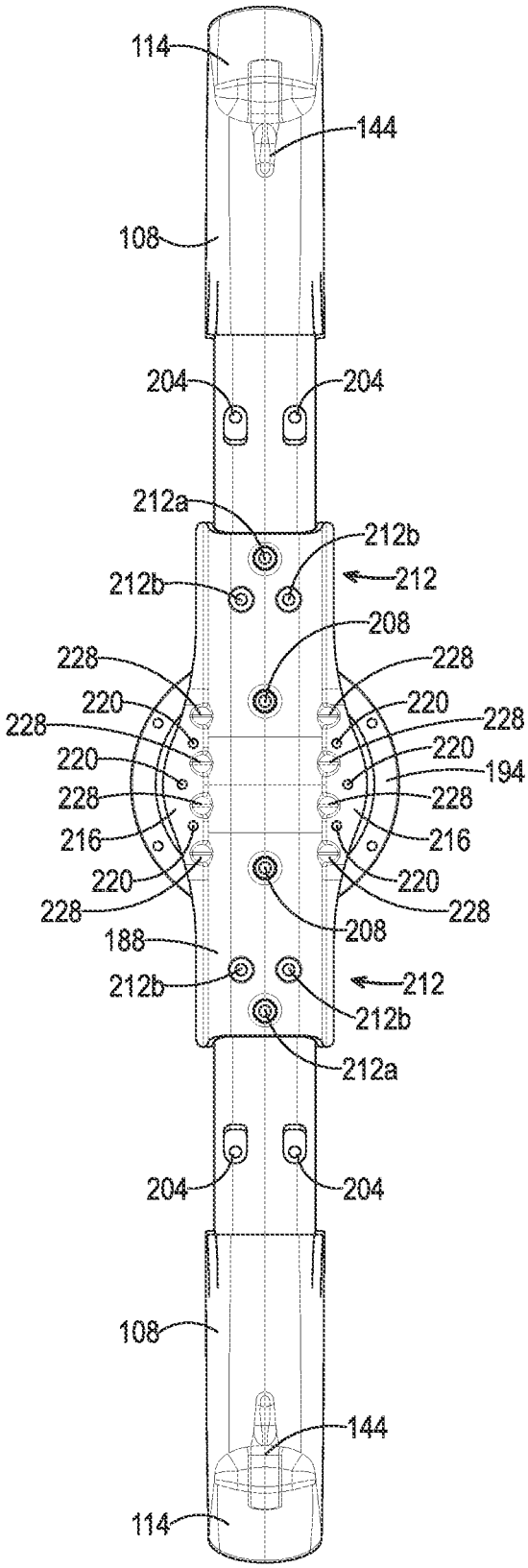
FIG. 8 is another top view of the hammock stand of FIG. 1, omitting the base and a yoke cover of the yoke for clarity

FIG. 8 is a top view of hammock stand 100 including yoke plate 188 and still omitting yoke cover 184 and base 120. As shown in FIG. 8, yoke plate 188 extends along both first ends 112, stopping short of third apertures 204. Yoke plate 188 includes a pair of first apertures 208 aligned with first apertures 198 of support arms 108, and two sets of second apertures 212 each aligned with respective second apertures 202 of the support arms. The aligned apertures are configured to receive fasteners for fastening yoke plate 188 to support arms 108 and in some cases to inner portion 192 of rotary bearing 180. Specifically, aligned first apertures 198, 208 and aligned second apertures 202*a*, 212*a* receive fasteners connecting yoke plate 188 and arm 108 without passing through yoke cover 184. Aligned second apertures 202*b*, 212*b* receive fasteners passing through yoke cover 184 as well as yoke plate 188 and arm 108. Fasteners passing through aligned first apertures 198, 208 also pass through apertures 214 (see FIG. 13) of inner portion 192 of rotary bearing 180, thereby anchoring yoke plate 188 and arm 108 to the inner portion of the bearing. In other examples, however, apertures 214 are omitted, such that there is no direct connection between the support arms and the bearing.

As shown in FIG. 8, yoke plate 188 has a pair of curved flanges 216 on either side. Flanges 216 have apertures 220, which are aligned with apertures 224 on inner portion 192 of rotary bearing 180. A plurality of apertures 226 in yoke cover 184 align with at least some of apertures 220, 224 (see FIG. 9). Fasteners (not shown) passing through aligned apertures 220, 224, and 226 rigidly attach yoke 182 to inner portion 192 of rotary bearing 180. A plurality of ribs 228 reinforce flanges 216.

Figure 9:
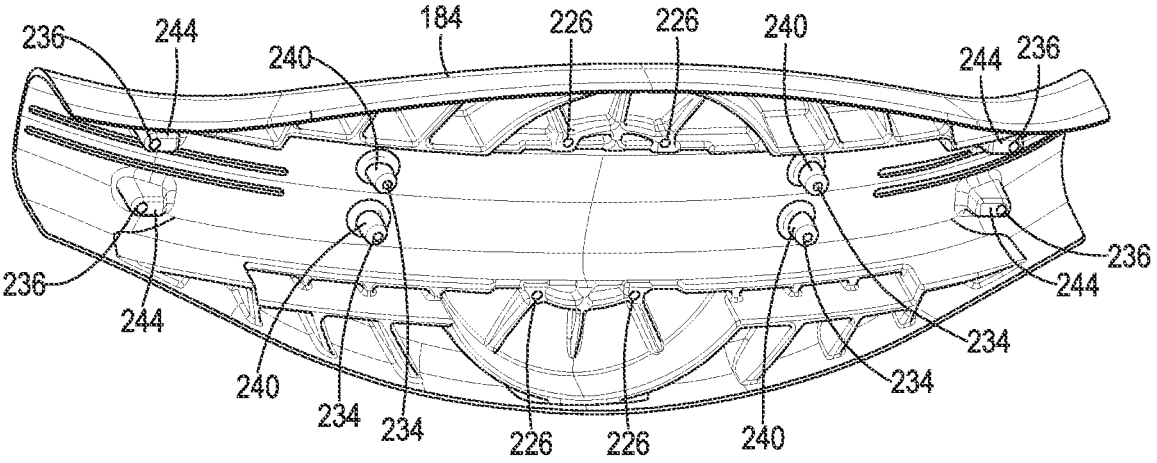
FIG. 9 is a bottom isometric view of a yoke cover of the hammock stand of FIG. 1, in accordance with aspects of the present teachings.

FIG. 9 is an isometric bottom view of yoke cover 184, without yoke plate 188. As shown in FIG. 9, yoke cover 184 includes two sets of first apertures 234 adjacent a longitudinally central portion of the yoke cover, and two sets of second apertures 236 adjacent respective ends of the yoke cover. First apertures 234 align with second apertures 202*b* of support arms 108 and second apertures 212*b* of yoke plate 188, allowing fasteners (not shown) to extend through the aligned apertures to fasten the yoke cover, yoke plate, and associated arm together. Second apertures 236 of yoke cover 184 align with third apertures 204 of support arms 108. Fasteners (not shown) extend through the aligned apertures to fasten the support arms to the yoke cover.

Figure 10:
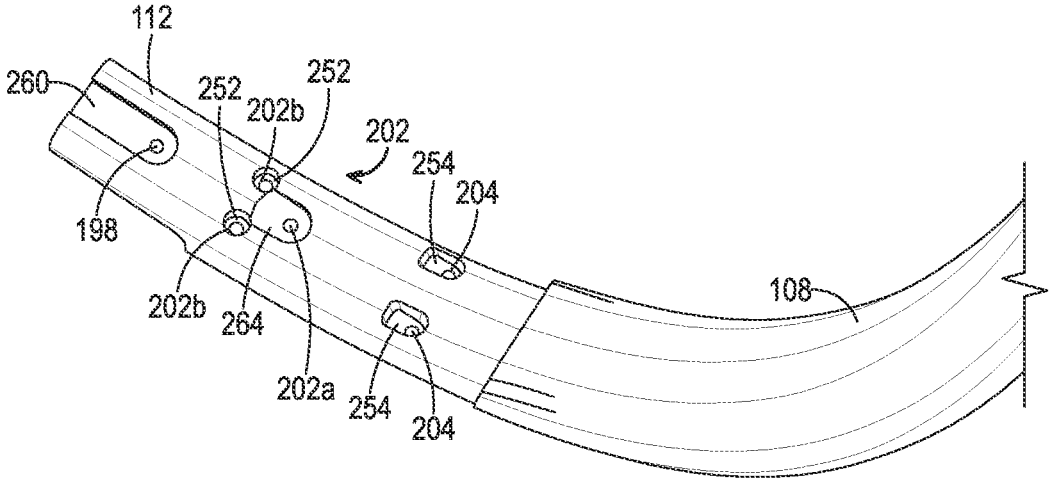
FIG. 10 is a partial isometric view of a support arm of the hammock stand of FIG. 1, in accordance with aspects of the present teachings.

In the depicted example, first apertures 234 of yoke cover 184 extend through respective first protrusions 240, and second apertures 236 of yoke cover 184 extend through respective second protrusions 244. As shown in FIG. 10, a partial isometric view of support arm 108, each second aperture 202*b* of each arm is disposed in a recess 252, and each third aperture 204 is disposed in a recess 254. First protrusions 240 of yoke cover 184 pass through apertures 212*b* of yoke plate 188 and are received in recesses 252 of support arm 108, and second protrusions 244 of yoke cover 184 are received in recesses 254 of support arm 108. Disposing the protrusions of yoke cover 184 in the recesses of support arms 108 provides registration and alignment between the yoke cover and the support arms, and strengthens the attachment of yoke 182 to the support arms.

Figure 11:
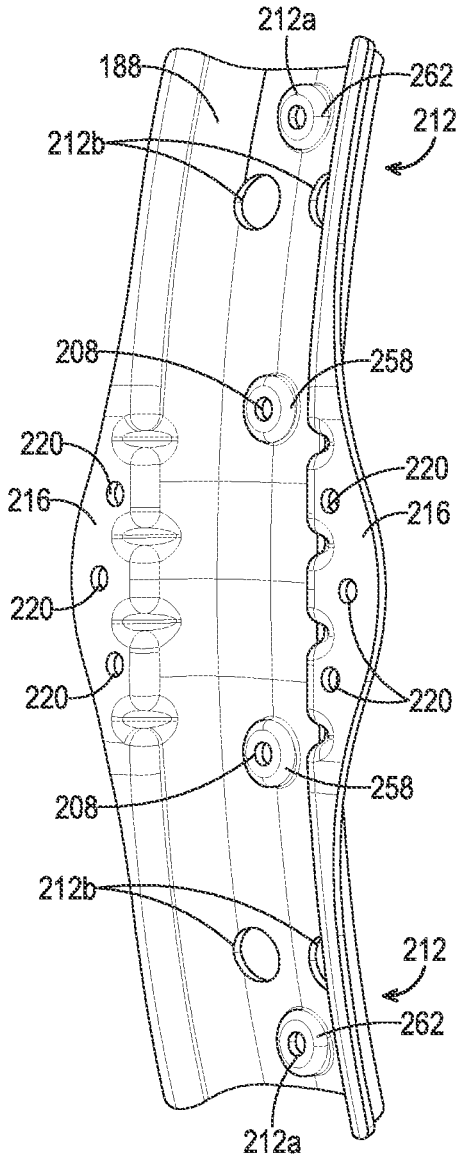
FIG. 11 is a bottom isometric view of a yoke plate of a yoke of the hammock stand of FIG. 1, in accordance with aspects of the present teachings.

FIG. 11 is an isometric bottom view of yoke plate 188. As FIG. 11 shows, apertures 208 of yoke plate 188 extend through respective protrusions 258, which are received in recesses 260 of support arm 108 (see FIG. 10). Apertures 212*a* of yoke plate 188 each extend through respective protrusions 262 of the yoke plate, which are received in recesses 264 of support arm 108 (see FIG. 10). Disposing the protrusions of yoke plate 188 in recesses of support arms 108 provides registration and alignment between the yoke plate and the support arms, and strengthens the connection between the yoke plate and the support arms.

Figure 12:
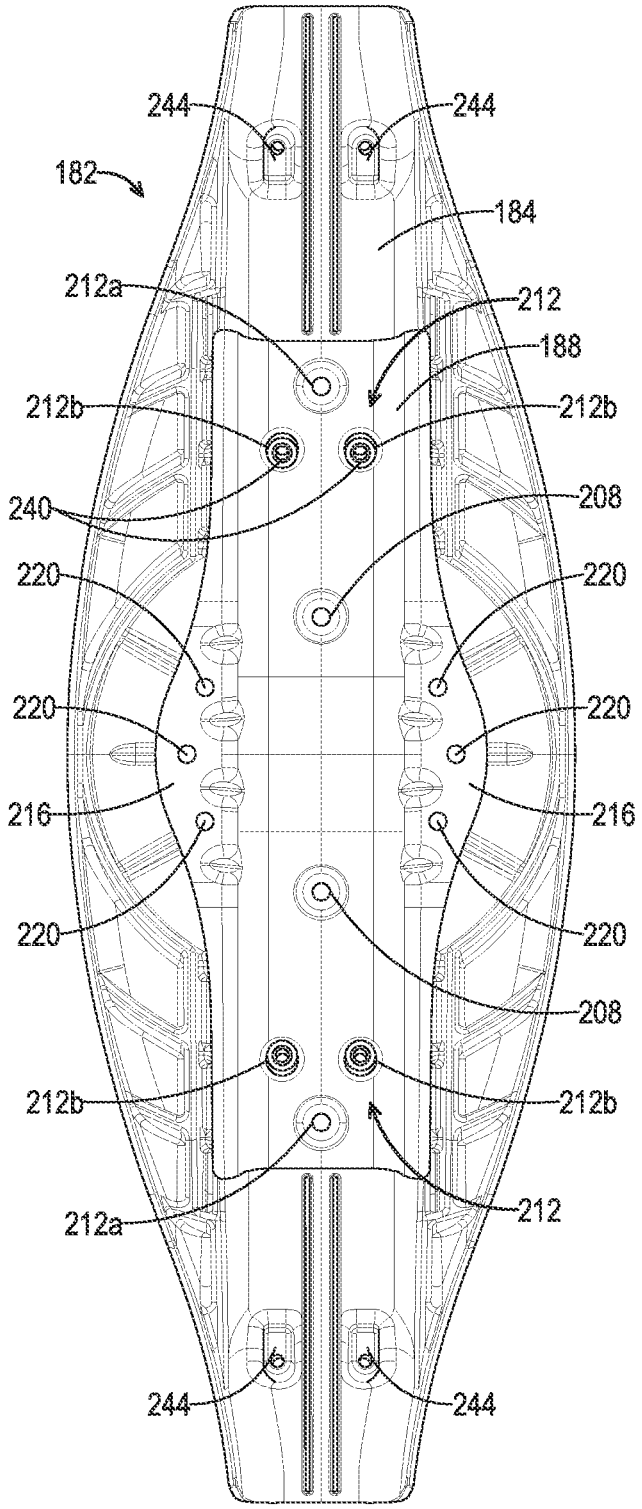
FIG. 12 is a bottom view of the yoke of the hammock stand of FIG. 11, including a yoke cover and the yoke plate of FIG. 11.

FIG. 12 is a bottom view of yoke 182, showing yoke plate 188 positioned within yoke cover 184.

Figure 13:
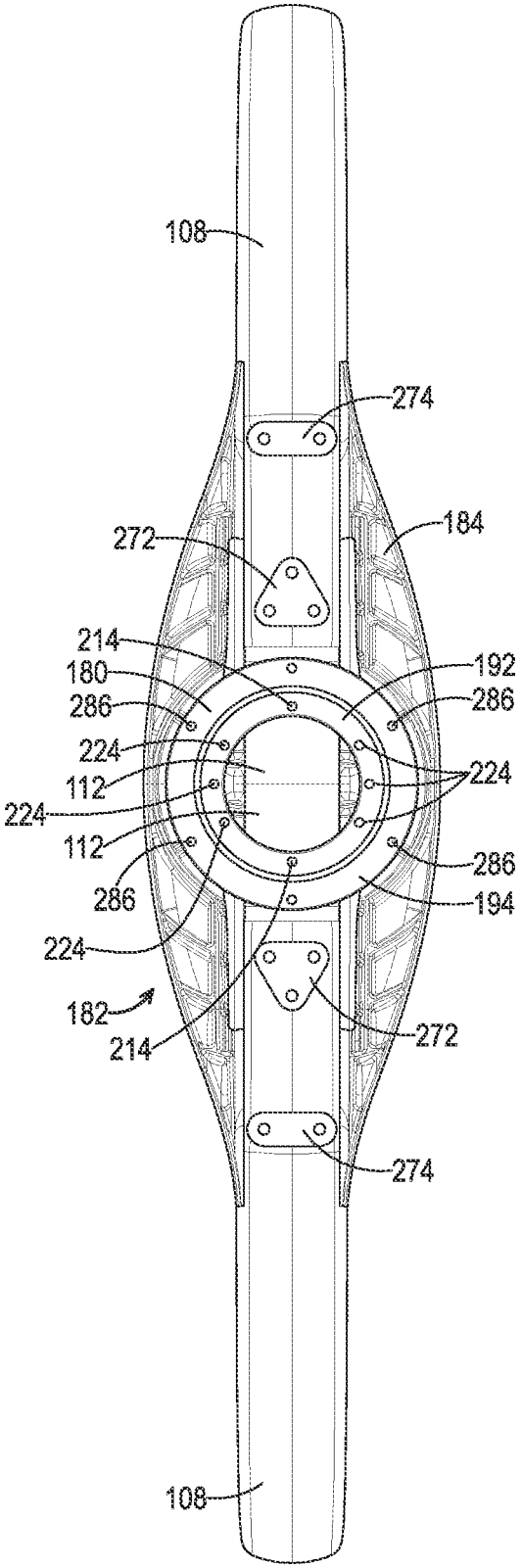
FIG. 13 is a bottom view of the hammock stand of FIG. 1, with the base omitted for clarity.

FIG. 13 is a bottom view of hammock stand 100, with base 120 omitted for clarity. As shown in FIG. 13, each support arm 108 has a first aperture plate 272 configured to reinforce fasteners received within second apertures 202 and a second aperture plate 274 configured to reinforce fasteners received within third apertures 204.

Figure 14:
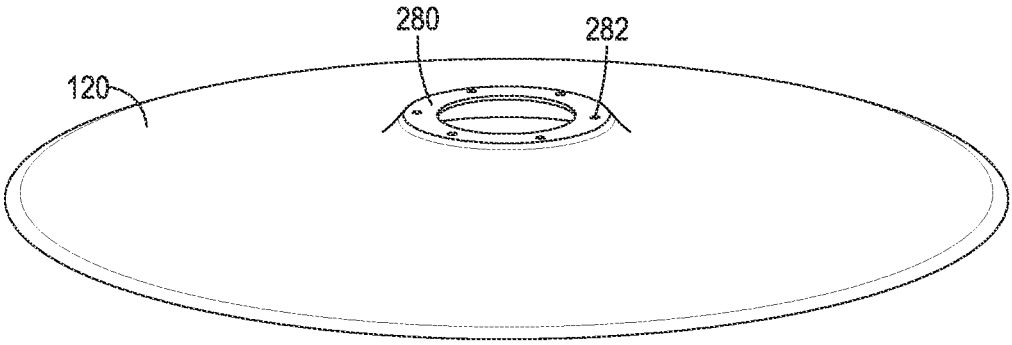
FIG. 14 is an isometric view of the base of the hammock stand of FIG. 1.
Figure 15:
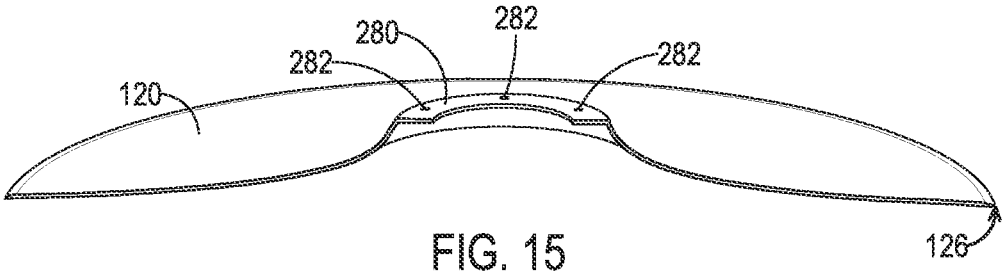
FIG. 15 is a sectional view of the base of FIG. 14.

FIG. 14 is an isometric view of base 120, depicting an annular upper surface 280 of the base. Upper surface 280 is generally flat (e.g., defining a plane). Upper surface 280 has a plurality of apertures 282 configured to align with apertures 286 (see, e.g., FIG. 13) of outer portion 194 of rotary bearing 180, such that fasteners passing through the aligned apertures fasten base 120 to the outer bearing portion. FIG. 15 is a sectional view of base 120, showing that the base is hollow inside and open at the bottom. Bottom rim 126 is configured to engage an underlying support surface (e.g., the ground) when hammock stand 100 is in use. Other types of bases may be suitable, for example bases which are solid rather than hollow, or which have other relative sizes or are shaped differently than base 120.

B. Illustrative Turntable Bearing

As shown in FIGS. 16-19, this section describes an illustrative turntable 300. Turntable 300, which may also be referred to as a slewing ring bearing, is an example of rotary bearing 180, described in the previous section.

Figure 16:
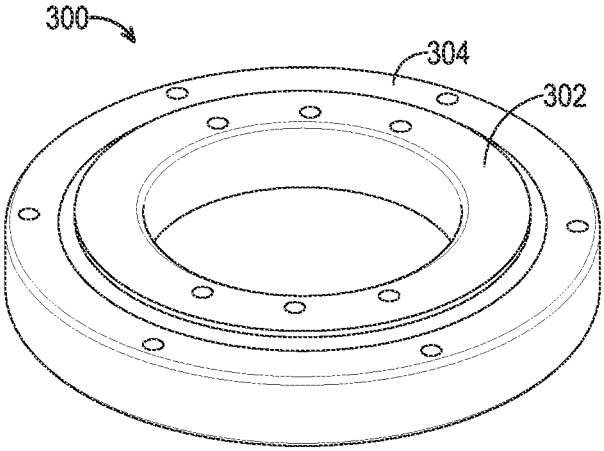
FIG. 16 is an isometric top view of an illustrative turntable bearing suitable for use in the hammock stand of FIG. 1, in accordance with aspects of the present teachings.

FIG. 16 is an isometric top view of turntable 300. Turntable 300 includes an inner ring 302 disposed coaxially within an outer ring 304. Rings 302, 304 each are generally shaped as an annular cylinder. Each ring 302, 304 has at least one aperture configured to receive fastener(s) to secure turntable 300 to other portions of a hammock stand (e.g., a yoke and/or support arms of the stand). In the depicted example, each ring includes six apertures, but in other examples, different numbers and/or positions of apertures may be used.

Figure 17:
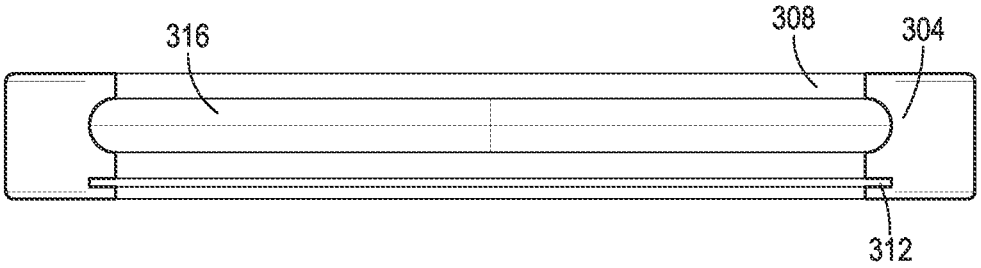
FIG. 17 is a sectional view of an outer ring of the turntable bearing of FIG. 16.
Figure 18:
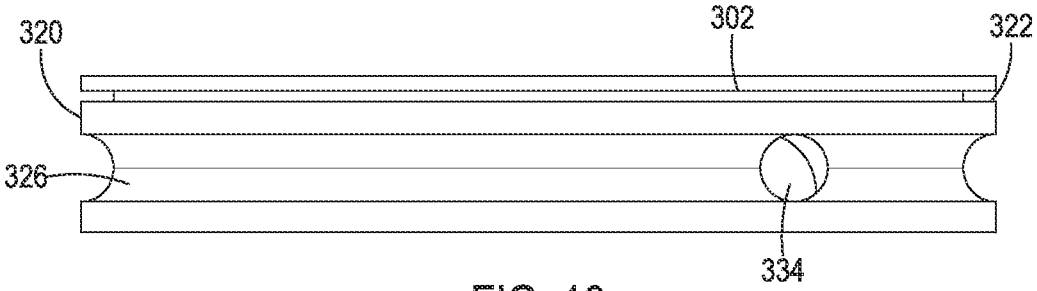
FIG. 18 is a front view of an inner ring of the turntable bearing of FIG. 16.
Figure 19:
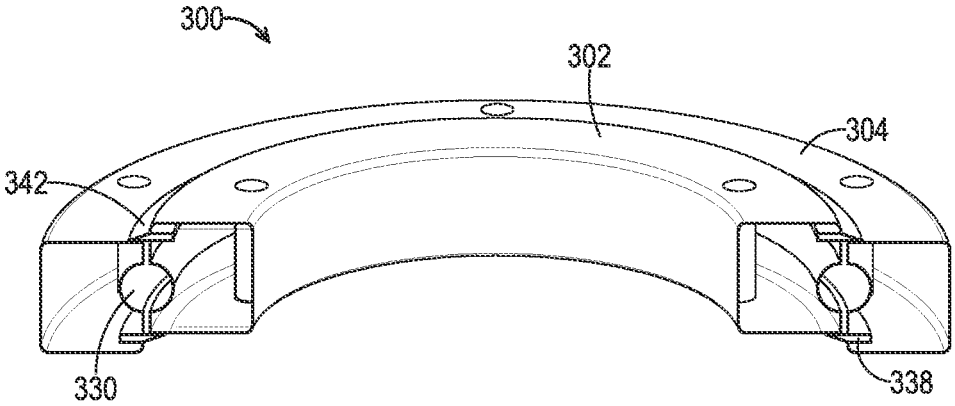
FIG. 19 is a sectional view of the turntable bearing of FIG. 16.

FIG. 17 is a sectional view of outer ring 304, and FIG. 18 is a front view of inner ring 302. As shown in FIG. 17, an inner surface 308 of outer ring 304 has a first circumferential slot 312. Inner surface 308 further includes a first circumferential groove 316 having a generally semicircular cross-sectional shape. As shown in FIG. 18, an outer surface 320 of inner ring 302 has a second circumferential slot 322 and a second circumferential groove 326. Second circumferential groove 326 has a generally semicircular cross-sectional shape. As shown in FIG. 19, a sectional view of turntable 300, second circumferential groove 326 aligns with first circumferential groove 316 to define a generally toroidal space 330 between the inner and outer rings. At least one bearing ball 334 is disposed within space 330 to facilitate relative rotation of the inner and outer rings.

A first flange 338 is disposed within first circumferential slot 312 of outer ring 304 such that the flange extends from the slot and supports inner ring 302. A second flange 342 is disposed within second circumferential slot 322 of inner ring 302 such that the flange extends from the slot and engages a top surface of outer ring 304. Second flange 342 helps to support inner ring 302 and to retain the inner ring within outer ring 304.

In some examples, the turntable comprises a lubricated bearing. For example, the turntable may include one or more grease fittings or other suitable devices allowing lubricant to be added to the turntable.

C. Illustrative Method of Assembly

Figure 20:
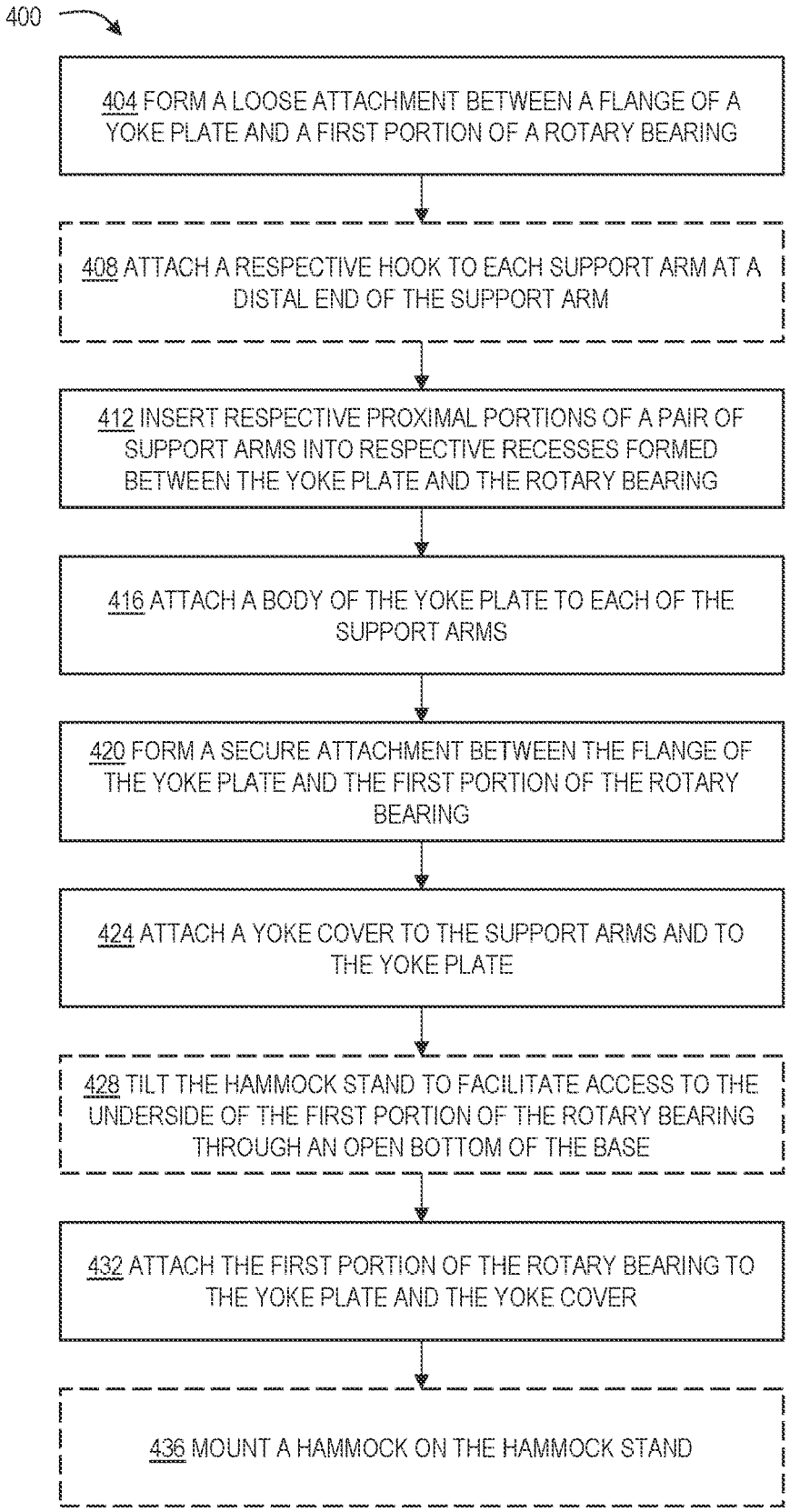
FIG. 20 is a flow diagram depicting steps of an illustrative method for assembling a hammock stand, in accordance with aspects of the present teachings.

This section describes steps of an illustrative method 400 for assembling a hammock stand; see FIG. 20. Aspects of hammock stands described elsewhere herein may be utilized in the method steps described below. Where appropriate, reference may be made to components and systems that may be used in carrying out each step. These references are for illustration, and are not intended to limit the possible ways of carrying out any particular step of the method.

FIG. 20 is a flowchart illustrating steps performed in an illustrative method, and may not recite the complete process or all steps of the method. Although various steps of method 400 are described below and depicted in FIG. 20, the steps need not necessarily all be performed, and in some cases may be performed simultaneously or in a different order than the order shown.

Step 404 of method 400 includes forming a loose (or less-than-tight) attachment between a flange (and/or other suitable portion) of a yoke plate and a first portion of a rotary bearing. A second portion of the rotary bearing is affixed to a base of the hammock stand and/or forms at least a part of the base of the hammock stand. In some examples, the rotary bearing comprises a turntable bearing, with the first portion of the rotary bearing being an inner ring of the turntable bearing and the second portion of the rotary bearing being an outer ring of the turntable bearing. In other examples, the first portion of the rotary bearing is the outer ring of the turntable bearing and the second portion is the inner ring.

In some examples, the yoke plate has two or more flanges, and step 404 includes forming a respective loose or less-than-tight attachment between each flange of the yoke plate and the first portion of the rotary bearing.

In some examples, forming the loose attachment between the flange of the yoke plate and the first portion of the rotary bearing includes inserting a threaded fastener through an opening of the flange of the yoke plate and into a threaded bore of the first portion of the rotary bearing and tightening the threaded fastener (e.g., only enough to form a loose connection). In examples wherein the yoke plate includes two or more flanges, fasteners may be inserted through one or more respective openings of each of two or more flanges and into corresponding threaded bores of the first portion of the rotary bearing.

Optional step 408 of method 400 includes attaching a respective hook to each support arm of a plurality of support arms (e.g., a pair of arms) of the hammock stand. The hooks are attached, e.g., at a distal end of the corresponding support arm. In some examples, each hook has a first portion disposed on a first side of the corresponding distal end and a second portion disposed on a second side of the corresponding distal end, and attaching the hook to the support arm includes inserting a fastener through an opening in the first portion of the hook, an opening in the distal end of the support arm, and an opening in the second portion of the hook.

At step 412, method 400 includes inserting respective proximal portions of a pair of support arms into respective recesses formed between the yoke plate and the rotary bearing. The loose connection formed at step 404 positions the yoke plate and rotary bearing relative to each other such that the recesses are formed, with the looseness of the connection allowing the proximal portions of the support arms to be easily inserted into the recesses.

In some examples, attaching hooks to the support arms (e.g., in option 408) is performed prior to inserting the proximal portions of the support arms into the recesses formed between the yoke plate and the rotary bearing. This may be convenient because it may be easier to manipulate the support arms before they are inserted into the recesses (e.g., because otherwise the support arms may slip out of the recesses as the hooks are being attached, because the distal ends of the support arms may be positioned high above the ground and difficult to reach when the proximal portions are in the recesses, etc.).

At step 416, method 400 includes attaching a body of the yoke plate to each of the support arms. In some examples, attaching the body of the yoke plate to each of the support arms includes passing a first fastener through a first set of aligned openings in the body of the yoke plate and a first one of the support arms; passing a second fastener through a second set of aligned openings in the body of the yoke plate, the first one of the support arms, and the first portion of the rotary bearing; passing a third fastener through a third set of aligned openings in the body of the yoke plate and a second one of the support arms; and passing a fourth fastener through a fourth set of aligned openings in the body of the yoke plate, the second one of the support arms, and the first portion of the rotary bearing. In some examples, the first, second, third, and fourth fasteners are passed through the corresponding openings from a top side of the yoke plate (e.g., with heads of the fasteners disposed adjacent an upper side of the body of the yoke plate).

At step 420, method 400 includes forming a secure attachment between the flange of the yoke plate and the first portion of the rotary bearing. In some examples, forming the secure attachment includes tightening the loose attachment formed at step 404. For example, in some cases forming the secure attachment between the flange of the yoke plate and the first portion of the rotary bearing includes tightening the threaded fastener of step 404 (e.g., sufficiently to form a rigid connection).

It may be convenient to perform step 416 prior to forming the secure attachment at step 420, because attaching the body of the yoke plate to the support arms at step 416 may be easier while the attachment between the flange of the yoke plate and the first portion of the rotary bearing is still loose (which can, e.g., facilitate alignment of openings in the yoke plate and arms).

At step 424, method 400 includes attaching a yoke cover to the support arms and to the yoke plate. In some examples, attaching the yoke cover to the support arms and to the yoke plate includes passing a fifth fastener through a fifth set of aligned openings in the first one of the support arms and the yoke cover; passing a sixth fastener through a sixth set of aligned openings in the first one of the support arms, the body of the yoke plate, and the yoke cover; passing a seventh fastener through a seventh set of aligned openings in the second one of the support arms and the yoke cover; and passing an eighth fastener through an eighth set of aligned openings in the second one of the support arms, the body of the yoke plate, and the yoke cover.

In some examples, the fifth, sixth, seventh, and eighth fasteners are passed through the corresponding openings from an underside of the corresponding support arm, such that respective heads of the fifth, sixth, seventh, and eighth fasteners are disposed adjacent the underside of the corresponding support arm. The base of the hammock stand may have a shape (e.g., a frustoconical shape having concave sides) that facilitates access to the underside of the support arms, facilitating insertion of the fasteners.

Optionally, at step 428, method 400 includes tilting and/or lifting the hammock stand to facilitate access to an underside of the first portion of the rotary bearing through an open bottom of the base, which may be convenient for step 432 (see below).

At step 432, method 400 includes attaching the first portion of the rotary bearing to the yoke plate and the yoke cover. In some examples, attaching the first portion of the rotary bearing to the yoke plate and the yoke cover includes passing a ninth fastener through a ninth set of aligned openings in the first portion of the rotary bearing, the flange of the yoke plate, and the yoke cover. The ninth fastener is, in some examples, passed through the corresponding openings from the underside of the first portion of the rotary bearing, such that a head of the ninth fastener is disposed adjacent the underside of the first portion of the rotary bearing. Accordingly, tilting the hammock stand to facilitate access to the underside of the first portion of the rotary bearing (e.g., at step 428) may make inserting the ninth fastener easier. Alternatively, or additionally, the hammock stand may be elevated (e.g., at least partially supported by table(s) and/or other suitable platform(s)) to facilitate access to the underside of the first portion of the rotary bearing. In some examples, the stand is not tilted, elevated, or otherwise repositioned for facilitating step 432.

Optionally, at step 436, method 400 includes fastening or mounting a hammock onto the hammock stand (e.g., by suspending ends of the hammock from hooks disposed at ends of the support arms).

In some examples, one or more portions of the hammock stand are padded (e.g., with a resilient material) to inhibit rocking and/or creaking when the hammock stand is in use. For example, padding may be disposed between the proximal ends of the support arms and the yoke plate, between the support arms and the yoke cover, between the yoke plate and the yoke cover, and/or between and/or on any other suitable portions of the hammock stand. In some cases, where the padding would otherwise cover an opening intended to receive a fastener, an aperture may be formed in the padding where the padding would cover the opening. In some examples, the apertures are not pre-formed in the padding and are created by insertion of the fastener (e.g., with the fastener breaking through the padding during assembly of the hammock stand).

In some examples, padding is added to one or more components of the hammock stand during assembly; alternatively, or additionally, one or more components of the hammock stand may be provided with padding (e.g., during manufacturing and/or at another suitable time prior to assembly of the stand).

D. Illustrative Combinations and Additional Examples

This section describes additional aspects and features of free-standing hammock stands, presented without limitation as a series of paragraphs, some or all of which may be alphanumerically designated for clarity and efficiency. Each of these paragraphs can be combined with one or more other paragraphs, and/or with disclosure from elsewhere in this application in any suitable manner. Some of the paragraphs below expressly refer to and further limit other paragraphs, providing without limitation examples of some of the suitable combinations.

A0. A free-standing rotatable hammock stand, comprising: a base configured to rest upon an underlying weight-bearing surface; a u-shaped support structure including a lower portion and two curved support arms extending generally upwardly and away from the lower portion, wherein a distal portion of each support arm is configured to support one end of a hammock; and a coupling assembly including a yoke configured to couple the lower portion of the u-shaped support structure to a bearing attached to the base, wherein the bearing is configured to allow 360 degree rotation of the u-shaped support structure relative to the base.

A1. The hammock stand of paragraph A0, wherein the yoke comprises a yoke cover reinforced by a yoke plate.

A2. The hammock stand of any one of paragraphs A0 through A1, wherein the bearing is configured to attach securely to a top portion of the base.

A3. The hammock stand of any one of paragraphs A0 through A2, wherein the yoke is configured to couple the two curved support arms to each other.

A4. The hammock stand of any one of paragraphs A0 through A3, wherein the u-shaped support structure includes a recess formed in the lower portion, and the bearing is configured to extend into the recess.

A5. The hammock stand of any one of paragraphs A0 through A4, further comprising a pair of s-shaped hooks, each hook including a first portion configured to wrap around a distal end portion of one of the support arms and a second portion configured to support one of the ends of the hammock.

B0. A hammock stand, comprising: a base; a rotary bearing configured to attach securely to an upper portion of the base; a pair of curved support arms, each having a distal end configured to support one side of a hammock; and a yoke configured to join the support arms to the rotary bearing; wherein the rotary bearing allows 360 degree rotation of the support arms around an axis perpendicular to the base, when the support arms are joined to the base.

B1. The hammock stand of paragraph B0, wherein each support arm includes a notch formed at a lower proximal end of the support arm, and the notches collectively form a recess shaped to accommodate the rotary bearing when the support arms are joined to the base.

B2. The hammock stand of any one of paragraphs B0 through B1, wherein the yoke is configured to join the support arms to the base by attaching securely to both the support arms and the rotary bearing.

B3. The hammock stand of any one of paragraphs B0 through B2, further comprising a pair of s-shaped hooks, each hook including a first portion configured to wrap around the distal end of one of the support arms and a second portion configured to support one of the ends of the hammock.

B4. The hammock stand of any one of paragraphs B0 through B3, wherein the base and the rotary bearing are annular in cross section.

B5. The hammock stand of any one of paragraphs B0 through B4, wherein the yoke is configured to join the support arms together into a u-shaped support structure.

C0. A free-standing rotatable hammock stand, comprising: a base having a bottom configured to rest upon an underlying weight-bearing surface, and a top defining a plane; and a u-shaped support structure having a lower portion configured to attach to the top of the base and two curved support arms extending generally upwardly away from the lower portion; wherein an upper portion of each support arm is configured to support one end of a hammock, and wherein attachment of the support structure to the base allows 360 degree rotation of the support structure about an axis of rotation perpendicular to the plane defined by the top of the base.

C1. The hammock stand of paragraph C0, wherein the support arms are integrally formed as a single u-shaped component.

C2. The hammock stand of paragraph C0, wherein the support arms are formed separately, and further comprising a yoke that couples the support arms together, wherein the support arms and the yoke collectively form the u-shaped support structure.

C3. The hammock stand of paragraph C0, further comprising a coupling assembly configured to couple the u-shaped support structure to the base securely.

C4. The hammock stand of paragraph C3, wherein the coupling assembly includes a rotary bearing configured to attach to the top of the base.

C5. The hammock stand of paragraph C4, wherein the coupling assembly includes a yoke configured to join the two support arms to each other, and to join the u-shaped support structure to the rotary bearing.

C6. The hammock stand of paragraph C5, wherein a bottom portion of each support arm includes a notch, and the notches collectively form a recess at the bottom of the u-shaped support structure which is configured to fit over at least a portion of the rotary bearing.

C7. The hammock stand of paragraph C6, wherein the bottom of the base comprises an annular rim.

D0. A method of assembling a free-standing hammock stand, the method comprising:

forming a loose attachment between a flange of a yoke plate and a first portion of a rotary bearing, a second portion of the rotary bearing being affixed to a base of the hammock stand;

inserting respective proximal portions of a pair of support arms into respective recesses formed between the yoke plate and the rotary bearing;

attaching a body of the yoke plate to each of the support arms;

forming a secure attachment between the flange of the yoke plate and the first portion of the rotary bearing;

attaching a yoke cover to the support arms and to the yoke plate; and attaching the first portion of the rotary bearing to the yoke plate and the yoke cover.

D1. The method of paragraph D0, wherein forming the loose attachment between the flange of the yoke plate and the first portion of the rotary bearing includes inserting a threaded fastener through an opening of the flange of the yoke plate and into a threaded bore of the first portion of the rotary bearing and tightening the threaded fastener (e.g., only enough to form a loose connection).

D2. The method of paragraph D1, wherein forming the secure attachment between the flange of the yoke plate and the first portion of the rotary bearing includes tightening the threaded fastener (e.g., sufficiently to form a rigid connection).

D3. The method of any one of paragraphs D0 through D2, wherein attaching the body of the yoke plate to each of the support arms includes:

passing a first fastener through a first set of aligned openings in the body of the yoke plate and a first one of the support arms;

passing a second fastener through a second set of aligned openings in the body of the yoke plate, the first one of the support arms, and the first portion of the rotary bearing;

passing a third fastener through a third set of aligned openings in the body of the yoke plate and a second one of the support arms; and passing a fourth fastener through a fourth set of aligned openings in the body of the yoke plate, the second one of the support arms, and the first portion of the rotary bearing.

D4. The method of any one of paragraphs D0 through D3, wherein attaching the yoke cover to the support arms and to the yoke plate includes:

passing a fifth fastener through a fifth set of aligned openings in the first one of the support arms and the yoke cover;

passing a sixth fastener through a sixth set of aligned openings in the first one of the support arms, the body of the yoke plate, and the yoke cover;

passing a seventh fastener through a seventh set of aligned openings in the second one of the support arms and the yoke cover; and passing an eighth fastener through an eighth set of aligned openings in the second one of the support arms, the body of the yoke plate, and the yoke cover.

D5. The method of paragraph D4, wherein the fifth, sixth, seventh, and eighth fasteners are passed through the corresponding openings from an underside of the corresponding support arm, such that respective heads of the fifth, sixth, seventh, and eighth fasteners are disposed adjacent the underside of the corresponding support arm.

D6. The method of any one of paragraphs D0 through D5, wherein attaching the first portion of the rotary bearing to the yoke plate and the yoke cover includes passing a ninth fastener through a ninth set of aligned openings in the first portion of the rotary bearing, the flange of the yoke plate, and the yoke cover.

D7. The method of paragraph D6, wherein the ninth fastener is passed through the corresponding openings from an underside of the first portion of the rotary bearing, such that a head of the ninth fastener is disposed adjacent the underside of the first portion of the rotary bearing.

D8. The method of paragraph D7, further comprising tilting the hammock stand to facilitate access to the underside of the first portion of the rotary bearing through an open bottom of the base.

D9. The method of any one of paragraphs D0 through D8, wherein the rotary bearing comprises a turntable bearing.

D10. The method of paragraph D9, wherein the first portion of the rotary bearing is an inner ring of the turntable bearing.

D11. The method of any one of paragraphs D0 through D10, further comprising attaching a respective hook to each support arm at a distal end of the support arm.

D12. The method of paragraph D11, wherein each hook has a first portion disposed on a first side of the corresponding distal end and a second portion disposed on a second side of the corresponding distal end, and attaching the hook to the support arm includes inserting a fastener through an opening in the first portion of the hook, an opening in the distal end of the support arm, and an opening in the second portion of the hook.

D13. The method of any one of paragraphs D11 through D12, wherein attaching the hooks to the support arms is performed prior to inserting the proximal portions of the support arms into the recesses formed between the yoke plate and the rotary bearing.

D14. The method of any one of paragraphs D11 through D13, further comprising mounting a hammock on the hammock stand (e.g., from the hooks).

D15. The method of any one of paragraphs D0 through D14, wherein padding is disposed between the proximal ends of the support arms and the yoke plate.

D16. The method of any one of paragraphs D0 through D15, wherein padding is disposed between the support arms and the yoke cover.

D17. The method of any one of paragraphs D0 through D16, wherein padding is disposed between the yoke plate and the yoke cover.

ADVANTAGES, FEATURES, AND BENEFITS

The different embodiments and examples of the hammock stand described herein provide several advantages over known solutions for supporting a hammock. For example, illustrative embodiments and examples described herein allow a hammock to be suspended by support arms coupled to a relatively small-area base, with the hammock disposed above the base. In this configuration, the assembled hammock and stand have a small, compact footprint compared to known hammock systems.

Additionally, and among other benefits, illustrative embodiments and examples described herein allow a swiveling hammock stand enabling rotation of the hammock about a central axis.

Additionally, and among other benefits, illustrative embodiments and examples described herein allow a hammock to be supported by two support arms mounted on a single, centrally located portion of the stand.

Additionally, and among other benefits, illustrative embodiments and examples described herein allow a hammock stand including two support arms that can comprise wood, metal, plastic, and/or any other suitable materials. In general, a base of the stand can interchangeably be coupled to arms of any suitable material(s). This allows a vendor to offer a variety of choices for arm material when selling the hammock stand without complicating their manufacture and/or supply processes, and allows a user of the stand to switch between arms comprising different material as desired.

Additionally, and among other benefits, illustrative embodiments and examples described herein allow a hammock to be supported by arcuate arms curving inward at an upper portion of the stand, such that the assembled hammock and stand comprise a tapered shape having a narrow profile.

Additionally, and among other benefits, illustrative embodiments and examples described herein allow a hammock stand that can be assembled and disassembled relatively easily (e.g., by an end user, for shipping to an end user, etc.), enabling the hammock stand to be transported and stored in more compact spaces than would otherwise be possible.

Additionally, and among other benefits, illustrative embodiments and examples described herein allow a hammock to be suspended on a free-standing, aesthetically appealing hammock stand.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A free-standing hammock stand, comprising:

a base including a rotary bearing; and a support structure including:

two curved support arms, wherein a proximal portion of each support arm is coupled to the rotary bearing and a distal portion of each support arm is configured to support an end of a hammock; and a yoke coupling the proximal portions of the curved support arms to the rotary bearing, wherein the proximal portions are disposed between the yoke and the rotary bearing;

wherein the rotary bearing is configured to allow rotation of the support structure relative to the base, wherein each support arm includes a recess formed in the proximal portion, and wherein the recess is configured to accommodate the rotary bearing.

2. The hammock stand of claim 1, wherein the distal portions of the two curved support arms bow toward each other.

3. The hammock stand of claim 2, wherein the hammock stand is configured to allow rotation of the support structure relative to the base only within an angular span of less than 360 degrees.

4. The hammock stand of claim 2, wherein a lower portion of the support structure is more curved than a higher portion of the support structure.

5. The hammock stand of claim 2, wherein the base has a bottom surface comprising an annular rim configured to rest on an underlying weight-bearing surface.

6. The hammock stand of claim 1, further comprising a pair of hooks each attached to the distal portion of a respective one of the curved support arms, wherein each hook includes a projection configured to support the end of the hammock, and a mounting portion configured to wrap around a top surface of the respective distal portion to secure the hook to the curved support arm.

7. The hammock stand of claim 1, wherein the two curved support arms are formed separately, and wherein the proximal portion of each curved support arm is coupled to the rotary bearing by the yoke attached to each of the curved support arms and to the rotary bearing.

8. The hammock stand of claim 1, wherein a bottom portion of the base has a concave frustoconical shape.

* * * * *